United States Patent [19]

Kogane

[11] Patent Number: 4,494,432

[45] Date of Patent: Jan. 22, 1985

[54] INTERCHANGEABLE CUTTER MECHANISM

[75] Inventor: Mikio Kogane, Kanagawa, Japan

[73] Assignee: Fuji Photo Film Co., Ltd., Kanagawa, Japan

[21] Appl. No.: 467,550

[22] Filed: Feb. 17, 1983

[30] Foreign Application Priority Data

Feb. 17, 1982 [JP] Japan ..... 57-24230

[51] Int. Cl.[3] ..... B26D 5/16; B26D 7/26

[52] U.S. Cl. ..... 83/559; 83/571; 83/628; 83/637

[58] Field of Search ..... 83/571, 481, 548, 551, 83/563, 628, 637, 559

[56] References Cited

U.S. PATENT DOCUMENTS 1,062,644 5/1913 Francisco ..... 83/571 X 3,867,861 2/1975 Hamisch, Sr. ..... 83/571

4,094,219 6/1978 Fabian et al. ..... 83/571 X 4,267,758 5/1981 Muhr et al. ..... 83/571

*Primary Examiner*—Frank T. Yost

*Attorney, Agent, or Firm*—Sughrue, Mion, Zinn, Macpeak and Seas

[57] ABSTRACT

A cutter comprising a movable block with an upper cutting edge and a stationary block having a lower cutting edge are movably connected together as a unit for simultaneous insertion and removal in a cutting mechanism to facilitate the interchangeability of different cutting edges. An eccentric cam driven by a drive motor is movable into and out of engagement with cam followers carried by the movable block for reciprocating the movable block relative to the stationary block and for permitting the removal of the two blocks as a unit from the cutter mechanism.

3 Claims, 5 Drawing Figures

INTERCHANGEABLE CUTTER MECHANISM

BACKGROUND OF THE INVENTION

The present invention is directed to an interchangeable cutter mechanism for cutting individual pictures from a continuous strip and more specifically to a plurality of cutter blocks each of which is comprised of a stationary cutting block and a movable cutting block of different sizes for use with a common drive means for cutting pictures having rounded corners from continuous strips of paper having different widths.

In general, continuous strips of printing paper are cut for every picture frame according to one of the three different cutting methods illustrated in FIG. 1. In FIG. 1A the continuous strip of printing paper is cut along the center line of the white frame portion which separates each picture so that each picture has a portion of the white strip attached thereto. In FIG. 1B the continuous strip of printing paper is cut twice with a single edge cutter or once with a double edged cutter so that each cut picture does not have any portion of the white strip attached thereto. In FIG. 1C the continuous strip of printing paper is cut once with a double edge cutter wherein each cutter edge is provided with rounded corners so that no portion of the white strip appears on either picture.

When continuous strip printing papers are cut in accordance with the various methods, different types of cutters are used. However, a problem is encountered when the size or width of a continuous strip of printing paper is varied. The paper width generally varies from 82.5 to 127 mm.

As is apparent from FIGS. 1A and 1B wherein straight cutting is involved, a single cutter of sufficient length may be used even when the paper width is changed. However, in the case of round corner cutting the edges must be in agreement with a specific paper width and accordingly the cutting edges must be changed whenever the paper width is changed.

Heretofore, in such a case, the cutter was disassembled to a considerable extent to replace the cutting edges and was then reassembled. Such a procedure required a considerable amount of time and labor. In order to minimize the time and labor required for dissembling and reassembling the cutter, a method was previously proposed in which a unit including not only the cutting edges but also the driving means for the cutting edges was replaced by another complete unit. However, such a method was not economical because a large number of parts are duplicated for each unit.

In most cutter mechanisms, a plurality of pairs of rollers and mechanisms for driving the rollers are arranged adjacent to the cutting mechanism so as to convey a continuous strip of printing paper past the cutting mechanism to obtain individual pictures by cutting the pictures from the strip. Therefore, in view of the proximity of the paper feed means it is extremely difficult to obtain access to the cutting mechanism for replacing only the cutting edges.

SUMMARY OF THE INVENTION

The present invention provides a new and improved cutting mechanism which obviates all of the aforementioned difficulties associated with conventional cutting mechanisms and which enables the ready interchange of cutting mechanisms for handling continuous strips of printing paper having different widths.

The present invention provides a new and improved cutting mechanism comprising a movable cutting block having upper cutting edge means thereon, a stationary cutting block having lower cutting edge means thereon, and driving means detachably connected to said movable cutting block for moving said upper cutting edge means relative to said lower cutting edge means for cutting a continuous strip of printing paper into individual picture frames, said movable cutting block and said stationary cutting block being removable as a single unit from said cutter mechanism.

The aforementioned and other objects, features and advantages of the invention will be apparent from the following more particular description of a preferred embodiment of the invention as illustrated in the accompanying drawings.

DETAILED DESCRIPTION OF THE INVENTION

Figure 1A:
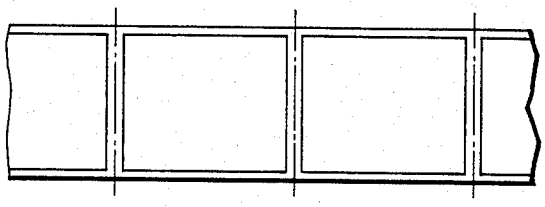
FIG. 1A, FIG. 1B and FIG. 1C are schematic diagrams showing the proposed cutting lines for three different types of cuts for separating individual picture frames from a continuous strip of printing paper.
Figure 1B:
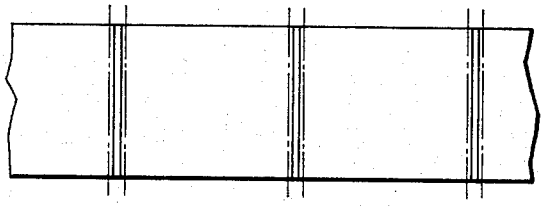
Figure 1C:
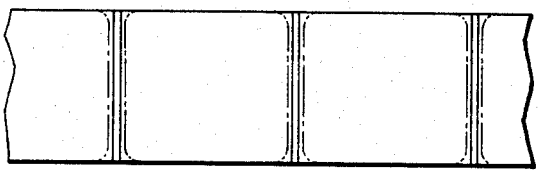
Figure 2:
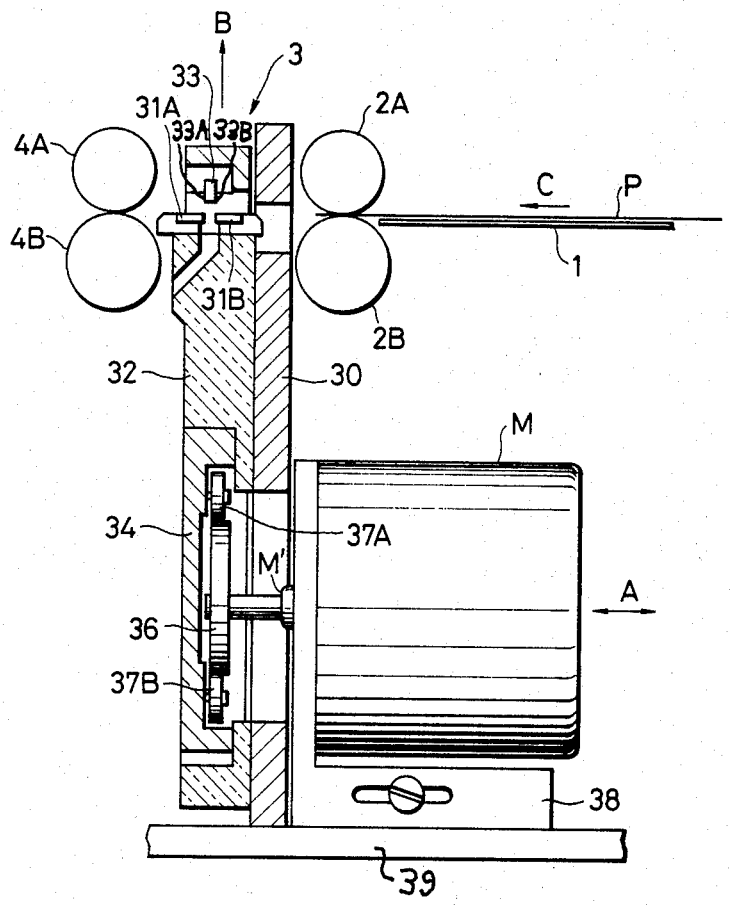
FIG. 2 is a schematic side elevation view, partly in section, showing the cutter mechanism according to the present invention.

The essential components of the cutting mechanism according to the present invention are best seen in FIG. 2 wherein a continuous strip of cutting paper P, having individual picture frames thereon, is moved along a guide plate 1 to a cutting mechanism 3 in the direction of the arrow C. A first pair of conveying rollers 2A and 2B feed the paper P to the cutting mechanism 3 and a second pair of conveying rollers 4A and 4B convey the individually cut picture frames away from the cutting mechanism 3.

Figure 3:
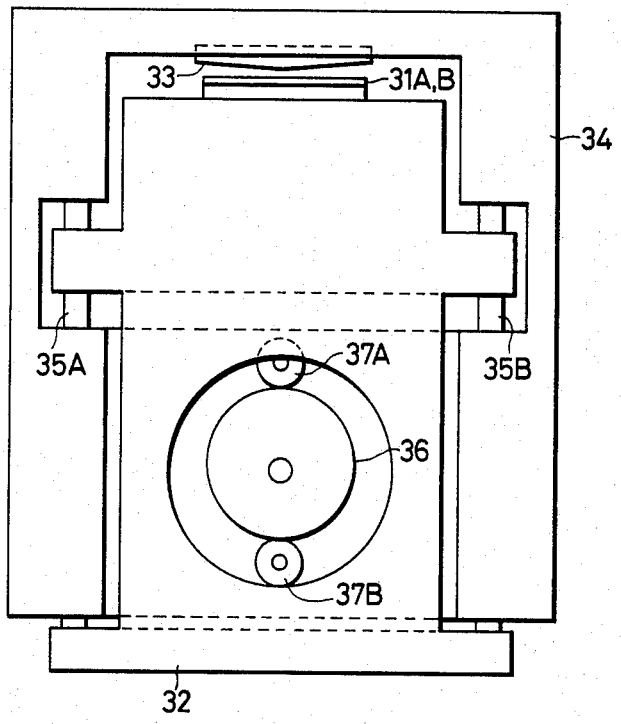
FIG. 3 is a front elevation view of the cutting mechanism according to the present invention as viewed from the driving motor side with the driving motor and base plate removed.

The cutting mechanism 3 includes a support plate 30 mounted on a base plate 39. A stationary cutting block 32 is detachably connected to the support plate 30 by any suitable means (not shown) and a movable cutting block 34 is supported for vertical movement relative to the stationary cutter block 32. An upper cutting edge means 33 having two cutting edges 33A and 33B is detachably connected by any suitable means to the movable cutting block 34 and a lower cutting edge means comprised of lower cutting edges 31A and 31B are detachably connected to the stationary cutting block 32 by any suitable means. The movable cutting block 34 is guided for vertical movement relative to the stationary cutting block 32 by means of guide shafts 35A and 35B as best seen in FIG. 3. The movable cutting block 34 is normally biased upwardly by spring means (not shown) so that the upper and lower cutting edges of the cutting mechanism are separated to permit the insertion of the printing paper P therebetween.

The movable cutting block 34 is moved up and down by means of an eccentric cam 36 which is mounted on a shaft M' of the driving motor M. The driving motor M is mounted for movement toward and and away from the support plate 30. A pair of bearing rollers 37A and 37B are rotatably mounted on the face of the movable cutting block 34 facing the motor M and are so positioned as to be in simultaneous engagement with the eccentric cam 36. Therefore, upon rotation of the eccentric cam 36 the movable cutting block 34 will be reciprocated up and down to bring the cutting edges into and out of operative engagement with each other for severing the individual picture frames from the continuous strip of printing paper. The motor M is mounted on a movable base 38 which is adapted to slide toward and away from the support plate 30 in the direction of the arrows A to bring the eccentric cam into and out of operative engagement with the bearing rollers 37A and 37B. Suitable handle means (not shown) may be provided for moving the mounting base 38 relative to the support plate 39 and adjustable securing means 40 may be provided for securing the motor in the desired position.

The movable cutting block 34 and the stationary cutting block 32 may be removed as a single unit from the cutting mechanism 3 by disconnecting the fixed cutting block 32 from the support plate 30 and lifting the two cutting blocks upwardly in the direction of the arrow B as shown in FIG. 2. Accordingly, even though the pairs of conveying rollers 2A, 2B and 4A, 4B, are arranged on both sides of the cutting mechanism 3 in close proximity thereto, the two cutting blocks can be readily taken out and replaced by a different pair of cutting blocks in order to accommodate different paper widths. The cutting blocks 32 and 34 can be inserted and removed as a unit in suitable guide means such as grooved guide plates (not shown) connected to the support plate 30. Thus, a number of different cutting mechanisms comprised of a movable cutting block and a stationary cutting block having different width cutting edge means can readily be interchanged using a common support plate 30, base plate 39, and movable motor M.

In the operation of the cutter mechanism thus described, a continuous strip of printing paper P on which individually framed pictures have been printed and which is to be cut into separate round cornered pictures is supplied in the direction of the arrow C in FIG. 2. A cut mark on the rear surface of the printing paper is detected by suitable detecting means (not shown) and in response to the detection signal from the detecting means the pairs of conveying rollers 2A, 2B and 4A and 4B and the cutting mechanism 3 are controlled to cut the continuous strip of paper P into individual round-cornered pictures. When it is desired to cut a printing paper requiring different width cutters than those presently in the mechanism, the operator will first stop the cutter mechanism. The driving motor M and the eccentric cam 36 are moved to the right as viewed in FIG. 2 to withdraw the eccentric cam from operative engagement with the rollers 37*a* and 37*b*. Thereafter, the fastening means, such as screws, or the like, which secure the stationary cutter block 32 to the support plate 30 are removed and the cutting blocks 32 and 34 are pulled upwardly in the direction of the arrow B along suitable guide grooves in side plates attached to the support plate 30. A different pair of cutting blocks having the proper widthcutting edges for the paper width to be cut are then inserted following a reverse procedure. Thus, only the two cutting blocks having the cutting edges thereon are replaced when the paper width is changed. In association with the replacement of the cutting blocks, the upper one of the pair of coveying rollers, namely the retaining roller 2A can also be replaced. In this modification the accuracy and combination of the two components can be improved. The method of engaging the motor with the movable cutting block and the method engaging the cutting blocks with the support plate are not limited to those which have been described above. The technical concept of the present invention is not limited to round-cornered cutting edges, but could also be utilized with other types of cutting edges. The principal result of the present invention is that different width cutting means can be readily replaced when the paper width is changed.

While the invention has been particularly shown and described with reference to preferred embodiments thereof, it will be understood by those in the art that the foregoing and other changes in form and detail may be made therein without departing from the spirit and scope of the invention.

I claim:

1. A cutter mechanism comprising support means, a stationary cutting block having first cutting edges thereon detachably connected to said support means, a moveable cutting block having second cutting edge means thereon, guide means operably inter-connecting said stationary cutting block and said moveable cutting block together as a unit and for guiding said moveable cutting block relative to said stationary cutting block to bring said first and second cutting means into and out of operative engagement with each other and drive means for moving said moveable cutting block relative to said stationary cutting block, said drive means being moveably supported on said support means for movement into and out of operative engagement with said moveable cutting block for permitting separation of said stationary and moveable cutting blocks as a unit from said support means.

2. A cutter mechanism as set forth in claim 1 wherein said drive means is comprised of a motor having a drive shaft, eccentric cam means secured to said drive shaft, and bearing means carried by said movable cutting block for reciprocating said movable cutting block relative to said stationary cutting block when said eccentric cam means is disposed in operative engagement with said bearing means.

3. A cutter mechanism as set forth in claim 1 further comprising feed means mounted adjacent said cutting edge means for feeding a continuous strip of paper intermittently past said cutting edge means for cutting said paper into individual segments.

* * * * *